United States Patent [19]

Pronzati

[11] Patent Number: 4,787,652

[45] Date of Patent: Nov. 29, 1988

[54] CROSSCOUNTRY SKI STICKS PARTICULARLY FOR THE NEW TECHNIQUE CALLED "SKATING"

[76] Inventor: Attilio Pronzati, Via Monasterolo, 16, 20010 Vanzago, Italy

[21] Appl. No.: 25,715

[22] Filed: Mar. 13, 1987

[30] Foreign Application Priority Data

Mar. 17, 1986 [IT] Italy ..... 21253/86[U]

[51] Int. Cl.[4] ..... A63C 11/24

[52] U.S. Cl. ..... 280/824

[58] Field of Search ..... 280/824, 819, 823, 821

[56] References Cited

U.S. PATENT DOCUMENTS

| | | | |
|---|---|---|---|
| 3,963,254 | 6/1976 | Atto | 280/824 |
| 4,129,312 | 12/1978 | Loffelholz | 280/824 |
| 4,288,101 | 9/1981 | Atto | 280/821 |

FOREIGN PATENT DOCUMENTS

| | | | |
|---|---|---|---|
| 400107 | 6/1924 | Fed. Rep. of Germany | 280/824 |
| 2510377 | 10/1975 | Fed. Rep. of Germany . | |
| 3335017 | 4/1984 | Fed. Rep. of Germany . | |
| 1267305 | 11/1961 | France . | |
| 2347949 | 11/1977 | France . | |
| 2514652 | 4/1983 | France | 280/824 |
| 598841 | 5/1978 | Switzerland . | |
| 0745530 | 7/1980 | U.S.S.R. | 280/824 |

*Primary Examiner*—David M. Mitchell

*Attorney, Agent, or Firm*—Young & Thompson

[57] ABSTRACT

The proposed crosscountry ski stick comprises a tube with a handgrip at its top and a snow-wheel at its lower end, fitted with a spike. The areas of contact with the snow are completely asymmetrical, that is without any symmetry axis. The spike lies in a plane which slants outwards with respect to the skier and forms an angle between 15° and 45°. The snow-wheel has a markedly asymmetrical shape i.e. it has no symmetry axis, it has two essentially straight sides which fan out from the tube forming an angle of between 60° and 90°. One of the straight sides is substantially perpendicular to the skier's direction of travel.

8 Claims, 1 Drawing Sheet

10
11
12
13
15
16
17
18
20
21
22
23
25
26
27
28
X
Y
A
2
15°-45°
60°-90°
45°

CROSSCOUNTRY SKI STICKS PARTICULARLY FOR THE NEW TECHNIQUE CALLED "SKATING"

There has recently been a transformation in crosscountry skiing technique, especially at competitive levels, with the introduction of the "skating" step.

In this technique the skis do not remain parallel to each other when sliding over the snow, as they did in conventional steps. With the skating technique the skis are used just like real skates to achieve greater thrust and thus a higher translatory speed.

This evolution has changed the design and geometry of crosscountry skis. A close study of this evolution has also revealed the need to up-date ski sticks too.

The aim of the present invention is a ski stick capable of aiding the skier who wishes to use the skating step.

Another aim is to prevent the stick from becoming entangled with the raised tail of the ski.

The aim has been achieved by envisaging ski sticks with totally asymmetrical base areas, i.e. with no symmetry axis.

The spike of the stick, normally sheared from sheet metal, extends along a plane which slants outwards with respect to the skier. This outward slant can also be accompanied by the known inclination in the plane of travel of the skier.

The snow-wheel is markedly asymmetrical, i.e. it has no symmetry axis. In particular, the snow-wheel can have two essentially straight peripheral sides which fan out from the tube. One of said sides is half till two thirds the length of the other and the other ends of said sides are joined by a wide curve.

The present invention will now be more fully described on the basis of an exemplary embodiment which is shown in the attached drawings, in which.

Figures 1, 2, 3, 4:
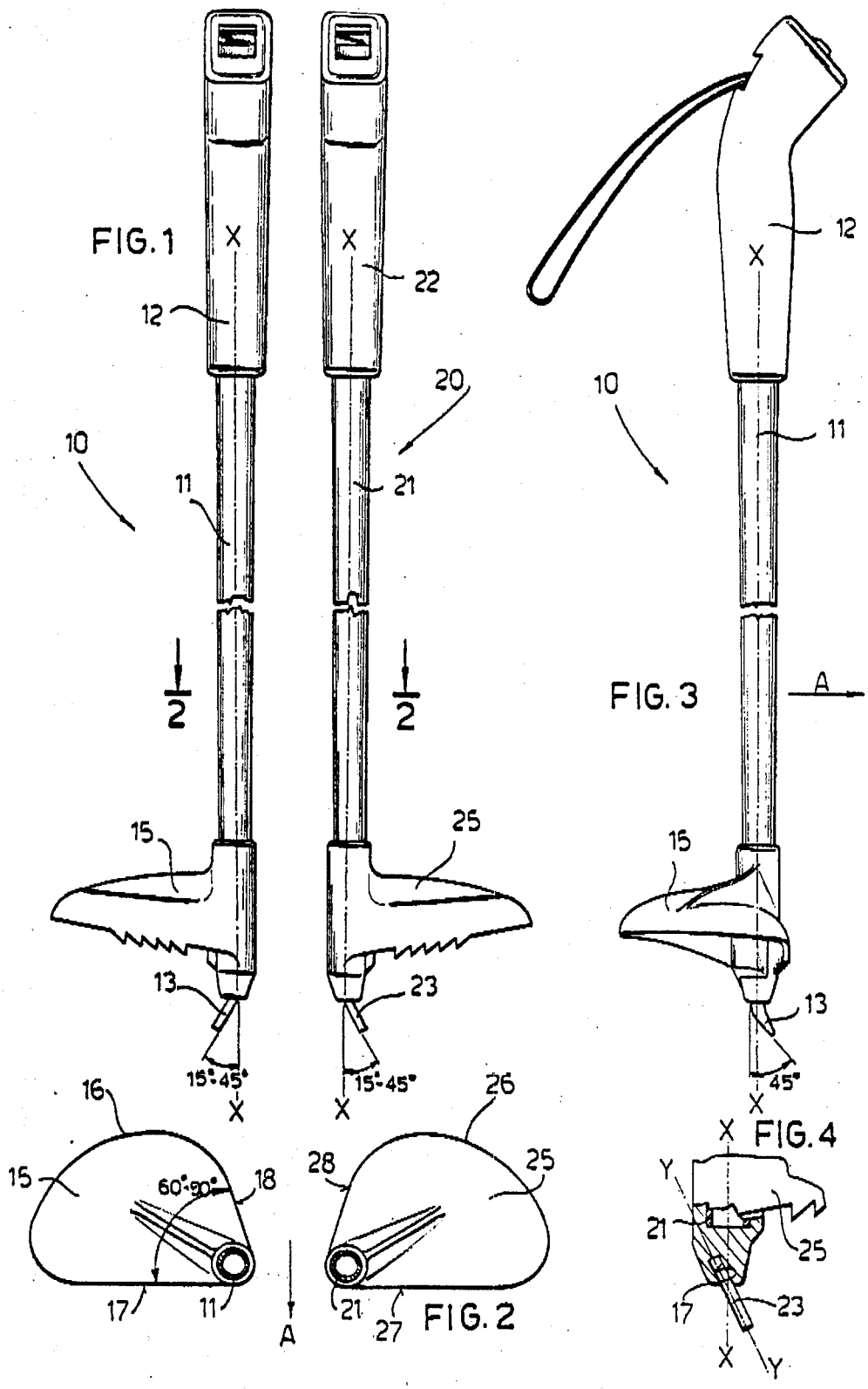
FIG. 1 is a partial front view in section of a proposed pair of sticks, as it will be used by the skier who will grasp the stick shown on the left with his right hand and the stick shown on the right in the figure with his left hand.
FIG. 2 is a plan view of section 2—2 of FIG. 1.
FIG. 3 is a side view of the left stick in FIG. 1 turned forwards through 90°.
FIG. 4 is the view of an enlarged section of the area of the spike which is circled in FIG. 1.

With reference to the drawings it will be noted that the sticks according to the present invention, indicated as a whole by 10 and 20, differ from each other and mirror each other perfectly, one right and the other left. Both are composed of a tube 11 and 21 respectively, a handgrip 12 and 22 respectively, a snow-ring 15 and 25 respectively and a spike 13 and 23 respectively.

The spikes 13 and 23 are inserted into a cavity 17 (FIG. 4) in the end of the stick, to be precise in the body forming the snow-wheel 15 and 25 respectively. The cavity 17 is angled so that the plane containing the spike 13 or 23 slants outwards by 15° to 25° with respect to the X—X axis of the tube 11 or 21 which forms the axis of the stick. The spike 13 or 23 can also be shaped so that its point also turns forwards with respect to the skier. In particular it can have a 45° forward slant with respect to the skier.

The snow-wheels are both designed so that the tube is at their edge. They have a totally asymmetrical shape, i.e. they have no symmetry axis. In particular, each snow-wheel can be shaped like a fan in which the two more or less straight peripheral sides, 17 and 18, 27 and 28 respectively, which start from the tube (11 and 21) are of unequal lengths (the hindmost one 18 and 28 is a third to a half shorter in length than the other one 17 and 27). The angle formed by said sides is between about 60° and 90°, in particular it is about 75°. Furthermore, one of said sides is essentially perpendicular to the skier's direction of travel which is indicated by an arrow A in FIGS. 2 and 3. The outer ends of these sides are joined together by a wide curve 16 and 26.

What I claim is:

1. A crosscountry ski stick comprising an elongated staff having at one end a hand grip and at the other end an imperforate snow wheel, said hand grip having a hand strap emerging rearwardly of the ski stick, the snow wheel having a sleeve surrounding and secured to the staff and having downwardly concave portions which project only laterally and rearwardly from said sleeve, said portions having a laterally outwardly projecting straight edge and a reawardly projecting straight edge, said edges comprising the laterally outermost boundary edges of the snow wheel and being disposed at an angle between 60° and 90° to each other.

2. A crosscountry ski stick as claimed in claim 1, said sleeve being annular and coaxial with said staff, and a single spike emerging from the lower end of the sleeve and being inclined downwardly in a laterally outward direction and being inclined forwardly downwardly, the upper end of said spike lying on the axis of the sleeve.

3. A crosscountry ski stick comprising an elongated staff having at one end a hand grip and at the other end a snow wheel, said hand grip having a hand strap emerging rearwardly of the ski stick, the snow wheel having a sleeve surrounding and secured to the staff and having downwardly concave portions which project only laterally and rearwardly from said sleeve, and a single spike emerging from the lower end of the sleeve and being inclined downwardly in a laterally outward direction and being inclined forwardly downwardly, the upper end of said spike lying on the axis of the sleeve.

4. A pair of crosscountry ski sticks each having an elongated staff having at one end a hand grip and at the other end an imperforate snow wheel, each said hand grip having a hand strap emerging rearwardly of the associated ski stick, each snow wheel having a sleeve surrounding and secured to the staff and having downwardly concave portions which project only laterally and rearwardly from said sleeve, said portions of each said stick having a laterally outwardly projecting straight edge and a rearwardly projecting straight edge disposed at an angle between 60° and 90° to each other, said edges comprising the laterally outermost boundary edges of the snow wheel, said ski sticks being asymmetric but being mirror images of each other on opposite sides of a vertical lane that extends forwardly and rearwardly.

5. A pair of crosscountry ski sticks as claimed in claim 4, each said sleeve being annular and coaxial with the associated said staff, and a single spike emerging from the lower end of each sleeve and being inclined downwardly in a laterally outward direction and being inclined forwardly downwardly, the upper end of each said spike lying on the axis of said associated sleeve.

6. A pair of crosscountry ski sticks as claimed in claim 4, said rearwardly projecting straight edge of one ski stick diverging rearwardly from said rearwardly projecting straight edge of the other ski stick.

7. A pair of crosscountry ski sticks each having an elongated staff having at one end a hand grip and at the other end a snow wheel, said hand grip having a hand strap emerging rearwardly of the ski stick, the snow wheel having a sleeve surrounding and secured to the staff and having downwardly concave portions which project only laterally and rearwardly from said sleeve, said sleeve being annular and coaxial with said staff, and a single spike emerging from the lower end of the sleeve and being inclined downwardly in a laterally outward direction and being inclined forwardly downwardly, the spikes on the respective sleeves diverging downwardly forwardly from each other.

8. A pair of crosscountry ski sticks as claimed in claim 7, the upper end of each said spike lying on the axis of its associated said sleeve.

* * * * *